US008617328B1

(12) United States Patent
Young et al.

(10) Patent No.: US 8,617,328 B1
(45) Date of Patent: Dec. 31, 2013

(54) FOAMED CELLULOID MORTAR PROPELLANT INCREMENT CONTAINERS

(75) Inventors: Ming-Wan Young, Basking Ridge, NJ (US); Costas G. Gogos, Wyckoff, NJ (US); Niloufar Faridi, Melville, NY (US); Linjie Zhu, Livingston, NJ (US); Peter Bonnett, Succasunna, NJ (US); Howard Shimm, Budd Lake, NJ (US); Elbert Caravaca, Budd Lake, NJ (US); Joseph Palk, Jr., Ledgewood, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 1235 days.

(21) Appl. No.: 12/483,420

(22) Filed: Jun. 12, 2009

Related U.S. Application Data

(63) Continuation-in-part of application No. 12/125,474, filed on May 22, 2008.

(60) Provisional application No. 60/939,660, filed on May 23, 2007, provisional application No. 61/061,249, filed on Jun. 13, 2008.

(51) Int. Cl.

| | |
|---|---|
| ***C06B 45/00*** | (2006.01) |
| ***C06B 45/10*** | (2006.01) |
| ***C06B 25/18*** | (2006.01) |
| ***C06B 25/20*** | (2006.01) |
| ***D03D 23/00*** | (2006.01) |
| ***D03D 43/00*** | (2006.01) |

(52) U.S. Cl.
USPC ..... 149/19.8; 149/2; 149/96; 149/100; 149/109.4; 149/109.6

(58) Field of Classification Search
USPC ..... 149/19.8, 2, 96, 100, 109.4, 109.6
See application file for complete search history.

(56) References Cited

U.S. PATENT DOCUMENTS

| | | | | |
|---|---|---|---|---|
| 5,529,649 | A * | 6/1996 | Lund et al. | 149/19.3 |
| 2009/0110905 | A1* | 4/2009 | Starostenko | 428/305.5 |
| 2009/0199938 | A1* | 8/2009 | Gottwald | 149/92 |
| 2012/0260814 | A1* | 10/2012 | Worrell et al. | 102/431 |
| 2012/0318123 | A1* | 12/2012 | Worrell et al. | 86/10 |

* cited by examiner

*Primary Examiner* — James McDonough
(74) *Attorney, Agent, or Firm* — Henry S. Goldfine

(57) ABSTRACT

An economical, low residue, mortar increment propellant container manufactured of foamed celluloid, which is composed of 50 to 84% nitrocellulose, having a nitrogen content of from about 10.5 to about 13.5%, and about 15 to about 50% camphor. The burn rate of the foamed celluloid can be enhanced by the addition of energetic additives, such as energetic plasticizers.

11 Claims, No Drawings

FOAMED CELLULOID MORTAR PROPELLANT INCREMENT CONTAINERS

CROSS-REFERENCE TO RELATED APPLICATIONS

This application is a continuation-in-part of currently copending U.S. patent application Ser. No. 12/125,474, filed May 22, 2008, which application claimed the benefit under 35 USC §119(e) of provisional application 60/939,660, filed May 23, 2007, which copending application and which provisional application are both hereby incorporated by reference. Further, this application also claims the benefit under 35 USC §119(e) of U.S. provisional patent application 61/061,249, filed on Jun. 13, 2008, which provisional application is also hereby incorporated by reference.

FEDERAL RESEARCH STATEMENT

The inventions described herein may be manufactured, used, and/or licensed by the U.S. Government for U.S. Government purposes.

FIELD OF THE INVENTION

The present invention relates to mortar round propellant increment containers and more particularly to such containers manufactured of low residue foamed celluloid.

BACKGROUND OF THE INVENTION

Conventionally mortar increment containers (MICs) used to contain propellant used by the U.S. Army for 60 mm, 81 mm, and 120 mm projectile propulsion systems are manufactured of a felt fiber, which is composed of nitrocellulose (NC), kraft, resin and various additives—that add to the energy imparted to the projectile. Unfortunately, this manufacturing process involves multiple steps including matting, condensing and pressing fibers, which are labor intensive and relatively costly. Further, it is known that moisture can negatively impact the velocity and range of felt MICs by as much as 5%.

An alternative material to felt MICs, which has been adopted by NATO, is non-porous celluloid (hereinafter celluloid), a material which is not significantly affected by moisture, is easily moldable and is relatively low cost—and which still adds to the energy imparted to the projectile. Celluloid is a class of compounds based upon nitrocellulose, a highly flammable compound formed by nitrating cellulose through exposure to nitric acid, or another strong nitrating agent. Typically, celluloid is composed of 70 to 80 parts nitrocellulose, nitrated to an 11% nitrogen, and about 30 parts camphor, which acts as a plasticizer for the nitrocellulose. The nitrocellulose and camphor are mixed in the presence of solvents, such as ethanol or in a mixer, followed by straining, roll milling and "hiding". A selected number of "hides" are then blocked at a desired pressure and temperature into a fused block, which is then sliced into sheets at desirable thickness after a conditioning period. Celluloid may contain a number of additives such as dyes and fillers for various applications—more common uses today include guitar picks, ping-pong balls, and some writing and musical instruments.

It is known that typical celluloid combustible cases experience residue issues, as well as, having mechanical strength and embrittlement issues, especially at low temperatures. Of these issues the most troubling is residue, as combustible increment containers used in mortar and artillery propulsion systems must burn cleanly, free of after-combustion residue, to avoid creating an obstruction within the launch tube of the projectile system. Any obstruction within the launch tube can lead to misfires or hang fires which could result in the immediate detonation of the projectile, with significant potential for injury or death of the crew.

Thus there is a need in the art for a relatively low cost, easily moldable, MIC material of manufacture that does not suffer from the wetness or manufacturing problems associated with felt, or the embrittlement, mechanical strength or residue problems associated with celluloid. The subject MIC material should contain an energetic constituent as does the felt fiber or celluloid of the prior art.

SUMMARY OF INVENTION

The present invention addresses the needs not met by the prior art, by providing a low residue, energetic, easily moldable MIC material, that is easily manufactured and does not suffer from wetness issue of the present felt MICs, and most importantly, at less than half the cost of the present felt MICs. Specifically, the present invention comprises MICs manufactured of foamed celluloid. Foamed celluloid is composed of 50 to 84% nitrocellulose, having a nitrogen content of from about 10.5 to about 13.5%, and about 15 to about 50% camphor. Such foamed celluloid MICs exhibit the same level of water resistance as non-foamed celluloid MICs while also having enhanced combustion characteristics, impact resistance, mechanical strength, and resistance to old weather embrittlement over the non-foamed celluloid.

The subject foamed celluloid MICs are relatively easy to manufacture from foamed celluloid sheets which are first foamed by the physical and/or chemical processes disclosed herein, and then formed into the desired MIC shape using known thermoforming techniques; wherein the foamed celluloid sheets are heated to a pliable forming temperature, and pressed into the MIC halves in a mold thereof (i.e. a generally u-shaped mold of the top and bottom sections of the MIC). Each thermoformed generally u-shaped half is punched/trimmed out of the sheet from which it was formed, and the two halve joined, using vibration welding to form a single MIC. A fill hole can be left open within the now formed MIC, to allow filling with conventional munition propellants and then sealed using a foamed celluloid plug, paper or nitrated tape, glued into place or sealed using a solvent. A solvent may also be used with or in place of welding of the two halves, by applying the solvent to the edges of one or both sides of the two halves. Preferably, the two halves should be joined by a combination of vibration welding and the use of a solvent, to ensure that the best seam possible is created, to avoid the possibility of a rupture of the seam or an incomplete seam and loss of propellant therefrom.

The nature of the subject invention will be more clearly understood by reference to the following detailed description and the appended claims.

DETAILED DESCRIPTION OF THE INVENTION

The present invention comprises MICs manufactured of foamed celluloid, which foamed celluloid is composed of 50 to 84% nitrocellulose, having a nitrogen content of from about 10.5 to about 13.5%, and about 15 to about 50% camphor. Compared to the non-foamed celluloid MICs, the foamed celluloid MICs exhibit equally good wetness performance and being less dense, there is less mass which needs to be consumed during combustion which in combination with the significantly larger surface area, dramatically increasing flame propagation and released energy. Further, the more flexible foamed structure versus the non-foamed celluloid, enhances the ability of the foamed celluloid to withstand impact and reduces brittleness.

The flame propagation and energy release of the foamed celluloid MICs of the present invention, in comparison to the felt and to non-foamed celluloid MICs of the prior art, can be demonstrated by the combustion performance of these materials, which is commonly characterized by the burn rate (cm/s) obtained in the closed bomb test. Use of closed bomb tests are well known in the art, as demonstrated by a Picatinny Arsenal interim report, Modernization of Closed Bomb Testing for Acceptance of Single Base Propellants, by John K. Domen, May 1976, available from the Defense Technical Information Center Online, www.DTIC.mil, as document ADB015387. The burn rate test results of selected celluloid samples are summarized in Table 1, below.

TABLE 1

Closed Bomb Test Results of Selected Celluloid Compositions.

| System | NC % | Cam % | N % | V (at 1,000 bar) [cm/s] |
|---|---|---|---|---|
| Non-foamed Celluloid | 80 | 20 | 11.1 | 2.1 |
| Foamed Celluloid | 80 | 20 | 11.1 | 89.0 |
| Felted Fiber | ~75 | N/A | 13.6 | 120.0 |

The cost for a foamed celluloid 120 mm mortar MIC is estimated at approximately 40% of that of a current equivalent felt 120 mm mortar MIC considering facilities, manufacturing and materials costs.

As stated above, the subject foamed celluloid MICs are relatively easy to manufacture from foamed celluloid sheets which are formed into the desired MIC shape using known thermoforming techniques. The foamed celluloid sheets are heated to a temperature at which they are pliable enough to be pressed into the generally u-shaped MIC halves using conventional thermoforming equipment such as manufactured by Illig Maschinenbau GmbH & Co Kg, Heilbronn, Germany. Each thermoformed u-shaped half is punched/trimmed out of the sheet from which it was formed, and the two halve joined, using vibration welding to form a single MIC. A fill hole can be left open within the newly formed MIC, to allow filling with conventional munition propellants and then sealed using a cover or plug, which can be manufactured of foamed celluloid or nitrated paper. Such a cover or plug can be affixed in place using a solvent, such as acetone. A combination of vibration welding and application of a solvent may also be used to join the two halves, by applying the solvent to the edges of one or both sides of the two halves. Preferably, the two halves should be joined by a combination of vibration welding and the use of a solvent, to ensure that the best seam possible is created to avoid the possibility of a rupture of the seam, or an incomplete seam, and loss of propellant therefrom.

Two general types of processes are used to foam plastics, the first involves use of a chemical foaming or blowing agent (CBA) that produce foaming or blowing gas through heat-induced decomposition, and the second involves the use of a physical foaming or blowing agent (PBA) that is forced under pressure into a polymer melt, without any chemical change. Foamed celluloid having the cell structure, physical and chemical properties required for the present invention, can preferably be manufactured by either (1) a combination of a chemical blowing agent (CBA) process and a physical blowing agent (PBA) process (detailed in Example 1, below) or (2) a PBA process alone (detailed in Example 2). Either process results in foamed celluloid sheets which can be thermoformed, as described above, into the subject MICs.

Example 1

Preferred Combined CBA/PBA Process for Manufacture of Foamed Celluloid

1. In a mixer that can be heated, such as a Measuring Mixer manufactured by Brabender GmbH & Co., Duisburg, Germany, combine about 50 weight % nitrocellulose (NC), having a nitrogen content of from 10.5 wt. % to 13.5 wt. %, preferably lower than 12.6% and most preferably about 11%; with about 15 wt. % camphor; with about 3% of a chemical blowing agent (CBA) that will generate $CO_2$ when decomposed, potential CBAs include sodium bicarbonate, azodicarbonamide (commonly referred to as AZ), benzene sulfonylhydrazide, and 5-phenyl tetrazole, and a commercial CBA which is particularly preferred is SAFOAM FPN3-40, manufactured and distributed by Reedy International Corp., Keyport, N.J.; and about 30% by weight of a solvent, such as a 50%/50% mixture of ethanol and methanol;
2. Run the mixer at a moderate agitation of about 30 rpm, for about 25 to about 35 minutes, at about 120 to about 125° F., until the mixture therein appears dough-like;
3. Add an additional quantity of solvent, about 25% of that originally added, increase the rpm of the mixer to about 45 rpm, and increase the temperature to about 150 to about 160° F.;
4. After approximately 30 minutes of additional mixing, for a total of about 60 minutes of mixing at this higher temperature and rotation speed, the mixture is decanted from the mixer onto a flat surface, e.g. a Teflon sheet, and placed within a conventional heated press, capable of temperatures of up to about 200° F. and pressure of over 10,000 lbs of force;
5. Within the heated press, the material is subjected to about 10,000 lbs of force, at about 160° F., until it sets up as a sheet, at the desired thickness of from about 0.1 to about 10 mm, a few minutes;
6. The now formed non-foamed celluloid sheet, containing a CBA, is then placed under vacuum over night to remove the solvent, forming a dried sheet;
7. The dried sheet is placed in a conventional autoclave, capable of temperatures of at least 400° F. and pressures of up to 1500 psi;
8. The autoclave is pressurized to from about 250 psi to about 1,000 psi by the injection of a PBA, such as nitrogen, carbon dioxide, or argon, preferably nitrogen or carbon dioxide, and most preferably carbon dioxide, and set at a temperature between about 250° F. and 350° F., preferably between about 250° F. and about 300° F., for a period of from 90 seconds to 30 minutes, preferably from about 2 minutes to about 20 minutes;
9. The desired foamed celluloid sheet is removed from the autoclave.

Example 2

Preferred PBA Process for Manufacture of Foamed Celluloid

1. A non-foamed celluloid sheet is prepared according to steps 1 through 5, above, except that no CBA ingredient is added;

2. The dried sheet is placed in a convention autoclave, capable of temperatures of at least 400° F. and pressures of up to 15,000 psi;

3. The autoclave is pressurized to from about 2,000 psi to about 12,000 psi, preferably from about 6,000 to about 8,000 psi, by the injection of a PBA, such as nitrogen, carbon dioxide, or argon, preferably nitrogen or carbon dioxide, and most preferably carbon dioxide, and set at a temperature between about 250° F. and about 350° F., preferably between about 250° F. and about 300° F., for a period of from about 10 minutes to about 24 hours;

4. The desired foamed celluloid sheet is removed from the autoclave.

The burn rate of the foamed celluloid can be enhanced by mixing an energetic additive to the initial nitrocellulose mixture of step 1 of Example 1; a preferred additive is an energetic plasticizer, such as BDNP A/F (1:1 mixture of BIS 2,2-Dinitropropyl acetate and BIS 2,2-Dinitropropyl formal), to provide an overall a higher nitration level.

We claim:

1. A low residue mortar increment container comprising:

foamed celluloid containing about 50% to about 84% nitrocellulose, having a nitrogen content of from about 10.5% to about 13.5%, and about 16% to about 50% camphor.

2. The mortar increment container of claim 1, which further comprises an energetic additive.

3. The mortar increment container of claim 2, wherein said energetic additive is BDNP A/F.

4. A method of manufacture of low residue mortar increment containers (MICS) comprising:

(a) combining in a heated mixer about 50 weight % nitrocellulose, having a nitrogen content of from 10.5 wt. % to 13.5 wt. %; with about 15 wt. % camphor; with about 3% of a chemical blowing agent; and about 32% by weight of a solvent, to form a mixture;

(b) agitating said mixture at about 30 rpm, for about 25 to about 35 minutes, at about 120 to about 125° F., until the mixture therein appears dough-like;

(c) adding an additional quantity of solvent, about 25% of that originally solvent quantity, while increasing the rpm of the mixer to about 45 rpm, and increasing the temperature to about 150 to about 160° F.;

(d) continuing to agitate for about another 30 minutes, thereafter decanting the mixer onto a flat surface, and placed the decanted mixture within a conventional heated press;

(e) pressing the decanted mixture at 10,000 lbs of force, at about 160° F., until it sets up as a sheet, at the desired thickness of from about 0.1 to about 10 mm;

(f) placing the sheet under vacuum over night to remove the solvent, thereby forming a dried sheet;

(g) placing the dried sheet in an autoclave;

(h) pressurizing the autoclave to, from about 250 psi to about 1,000 psi by the injection of a PBA, and raising the temperature in the autoclave to between about 250° F. and 350° F., for a period of from 90 seconds to 30 minutes, to form a sheet of foamed celluloid;

(i) heating the sheet of foamed celluloid to a pliable forming temperature and then pressed into MIC half molds to form the respective generally u-shaped halves of the MIC;

(j) joining two generally u-shaped halves to form a whole MIC, by vibration welding, application of a solvent, or a combination thereof.

5. The method of manufacture of mortar increment containers claim 4, wherein a fill hole is left open within one of the two halves.

6. The method of manufacture of mortar increment containers of claim 4, wherein the chemical blowing agent is selected from the group consisting of sodium bicarbonate, azodicarbonamide, benzene sulfonylhydrazide, 5-phenyl tetrazole, and SAFOAM FPN3-40.

7. The method of manufacture of mortar increment containers of claim 4, wherein the solvent is a mixture of 50% ethanol and 50% methanol.

8. A method of manufacture of low residue mortar increment containers (MICS) comprising:

(a) combining in a heated mixer about 50 weight % nitrocellulose, having a nitrogen content of from 10.5 wt. % to 13.5 wt. %; with about 17 wt. % camphor; and about 33% by weight of a solvent, to form a mixture;

(b) agitating said mixture at about 30 rpm, for about 25 to about 35 minutes, at about 120 to about 125° F., until the mixture therein appears dough-like;

(c) adding an additional quantity of solvent, about 25% of that originally solvent quantity, while increasing the rpm of the mixer to about 45 rpm, and increasing the temperature to about 150 to about 160° F.;

(d) continuing to agitate for about another 30 minutes, thereafter decanting the mixer onto a flat surface, and placed the decanted mixture within a conventional heated press;

(e) pressing the decanted mixture at 10,000 lbs of force, at about 160° F., until it sets up as a sheet, at the desired thickness of from about 0.1 to about 10 mm;

(f) placing the sheet under vacuum over night to remove the solvent, thereby forming a dried sheet;

(g) placing the dried sheet in an autoclave;

(h) pressurizing the autoclave to a pressure of from about 2,000 psi to about 12,000 psi, by the injection of a PBA, at a temperature between about 250° F. and about 350° F., for a period of from about 10 minutes to about 24 hours, thereby foaming the dried sheet to a foamed celluloid sheet;

(i) removing the foamed celluloid sheet is removed from the autoclave;

(j) heating the sheet of foamed celluloid to a pliable forming temperature and then pressed into MIC half molds to form the respective generally u-shaped halves of the MIC;

(k) joining two generally u-shaped halves to form a whole MIC, by vibration welding, application of a solvent, or a combination thereof.

9. The method of manufacture of mortar increment containers of claim 6, wherein a fill hole is left open within one of the two halves.

10. The method of manufacture of mortar increment containers of claim 6, wherein the PBA is selected from the group consisting of nitrogen, carbon dioxide, or argon.

11. The method of manufacture of mortar increment containers of claim 6, wherein the solvent is a mixture of 50% ethanol and 50% methanol.

* * * * *